United States Patent [19]

Durbin et al.

[11] Patent Number: 4,719,852

[45] Date of Patent: Jan. 19, 1988

[54] AIRCRAFT TRASH COMPACTOR

[75] Inventors: James L. Durbin, Valencia; Robert M. Clemens, Newhall, both of Calif.

[73] Assignee: A.K.G.S., Las Vegas, Nev. ; a part interest

[21] Appl. No.: 889,685

[22] Filed: Jul. 24, 1986

[51] Int. Cl.[4] ..... B30B 15/30

[52] U.S. Cl. ..... 100/229 A; 100/255

[58] Field of Search ..... 100/215, 229 R, 229 A, 100/255, 240; 53/527; 141/73, 80

[56] References Cited

U.S. PATENT DOCUMENTS

| | | | |
|---|---|---|---|
| 3,748,820 | 7/1973 | Fox | 100/229 A |
| 3,838,636 | 10/1974 | Engebretsen | 100/229 A |
| 3,910,181 | 10/1975 | Andrews et al. | 100/255 X |
| 3,945,313 | 3/1976 | Komberec et al. | 100/215 X |
| 4,064,798 | 12/1977 | Wolbrink et al. | 100/255 X |
| 4,620,479 | 11/1986 | Diamond et al. | 100/229 A X |

*Primary Examiner*—Andrew M. Falik

*Attorney, Agent, or Firm*—Fulwider, Patton, Rieber, Lee & Utecht

[57] ABSTRACT

An improved aircraft trash compactor having an elongated inner chamber which is separated into front and rear chamber sections by means of a movable door or wall disposed transversely across the width of the chamber. The movable door or wall supports the rear panel of the trash container in the front chamber section during the compaction of trash therein and may be moved to an out-of-the-way position to allow the filled trash container to be moved into the rear chamber section for storage or disposal. The filled trash container in the rear chamber section supports the rear panel of a trash container in the front chamber section during the compaction of trash therein.

10 Claims, 9 Drawing Figures

FIG. 4
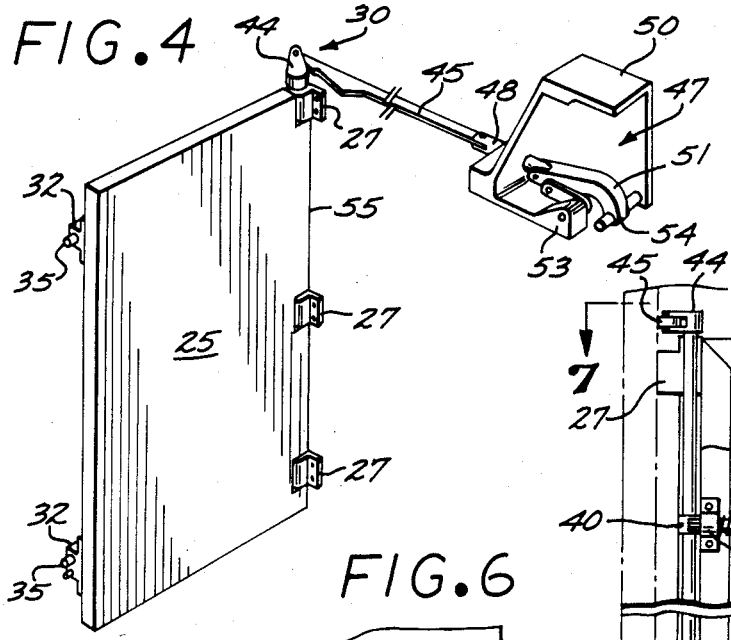
FIG. 5
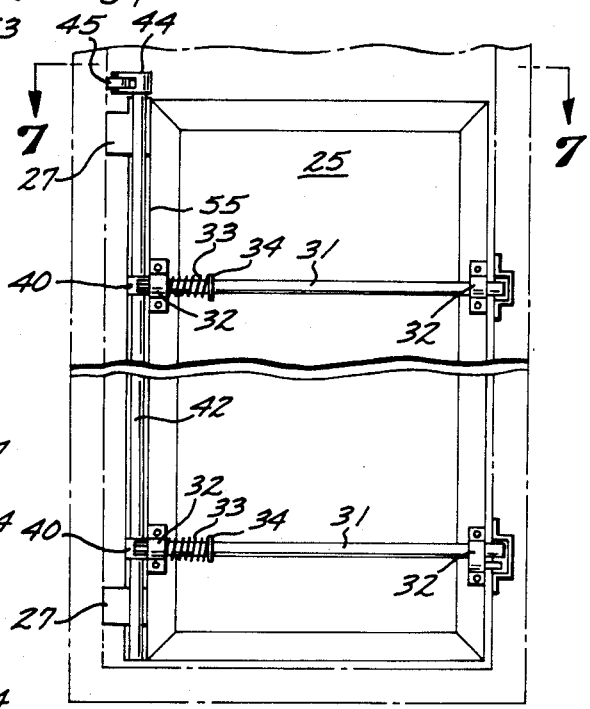
FIG. 6
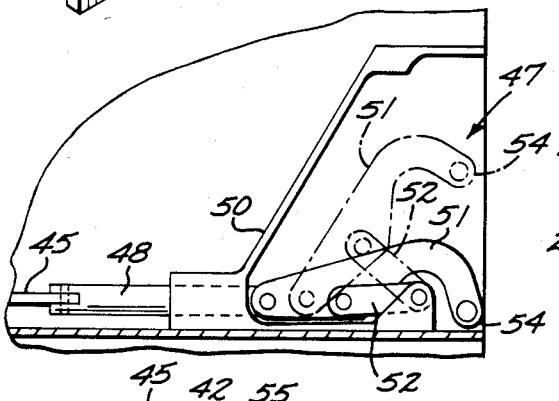
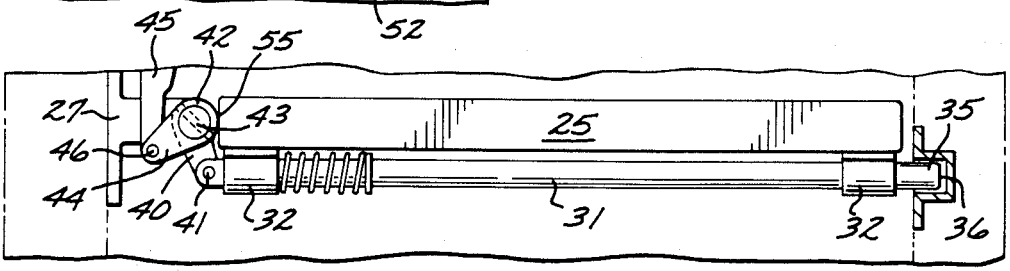
FIG. 7
FIG. 8
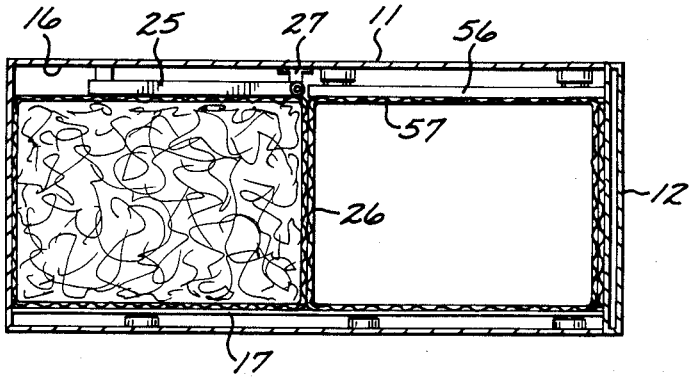

AIRCRAFT TRASH COMPACTOR

BACKGROUND OF THE INVENTION

This invention generally relates to trash compactor systems and particularly to trash compactor systems for aircraft or aerospace vehicles.

The handling of large amounts of waste material generated during the flight of passenger-carrying aircraft has long presented a major problems to in-flight service personnel. The introduction of wide-bodied jet aircraft with very high density passenger configurations has exacerbated the problem, not only from an in-flight service point of view but also with respect to flight safety. Current methods of waste disposal on board passenger-carrying aircraft include the use of paperboard boxes and plastic bags in conjunction with trash bins or trash carts which require high volume storage areas. Frequently, when the primary trash storage areas are filled, plastic bags or paper bags with plasic inserts are used to collect excess trash. These excess trash containers are frequently stored during the flight in the galley areas or in lavatories, thereby rendering them unusable for passengers, and even behind the last row of passenger seats or in unused passenger seats. Such field trash containers are not only unsightly, but they also present a serious risk of on-board fire due to the highly combustible nature of the trash and the possibility that ignition sources may have been introduced into the container along with the trash. An additional safety hazard is created when excess filled trash containers are stored in exit areas because these containers may block or impede egress in emergency situations.

During a typical five-hour flight with statistically average passenger loads on wide-bodied aircraft (e.g. from Hawaii to California or across the continental United States), approximately 20 to 30 cubic feet of trash may be generated. On longer transoceanic routes lasting up to 15 hours, 80 to 120 cubic feet of trash may be generated due to the number of meal, snack, and bar services that are offered.

The trash compactors now available for residential uses are incapable of handling the large volumes of trash generated on board an aircraft within the time constraints for in-flight service. They have neither the power, the space saving capability, nor the cycle time sufficient to meet the in-flight service requirements.

For trash compactors to be used on aircraft, they have to be placed within the galley of the aircraft, or in an easily accessible processing location, such as a closet, or have to be fitted onto rolling carts of the same or similar size as the food and beverage carts used on the aircraft. Thus, such compactors would have to be relatively small, lightweight, and be custom configured to fit in the many appropriate installation locations aboard aircraft and space vehicles. Commercial or industrial trash compactors now available are much too large and heavy for such uses, and they require electrical power not ordinarily available on the aircraft.

The aircraft trash compacting system described in copending application Ser. No. 635,141 U.S. Pat. No. 4,620,479 represented a substantial advance in the art which preceded it. One aspect of the trash compactor described which was particularly attractive was the double chamber trash compactor wherein a filled trash container might be stored in the rear chamber. However, it was found that the rear panel of the cardboard trash containers were frequently not sufficiently strong to contain the compacting pressure without tearing seams and the like.

Thus a need remains for a dual-chambered trash compactor which can support the rear panel of the trash container during the compacting of trash therein. The present invention satisfies this need.

SUMMARY OF THE INVENTION

This invention generally relates to a trash compactor for aircraft or aerospace uses and particularly to an improved trash compactor having a double-sized internal chamber, one portion of which is used for compacting trash in a trash container disposed therein and the other portion used to store or dispose of filled trash containers.

The trash compacting system of the invention generally comprises a housing having an internal elongated chamber with front and rear chamber sections which are adapted to receive trash containers. A reciprocating compacting head or platen is provided in the upper portion of the front chamber section which, upon extension thereof, compacts trash in a trash container disposed in the front chamber section. A movable support door or wall is disposed between the front and rear sections of the internal chamber with means to fix the door or wall in a transverse position across the width of the internal chamber so that it will support the adjacent rear panel of a trash container in the front chamber section during the compaction of trash therein. Means are also provided to move the door or wall supporting the rear panel of the trash compactor to an out-of-the-way position so that a filled trash container in the front chamber section may be pushed into the second chamber section for storage or subsequent disposal.

The movable support door is preferably hingedly mounted against one of the sidewalls of the internal chamber dividing this chamber into the front and rear sections. The door is mounted so that it will swing into the second chamber section to allow filled trash containers to be pushed from the first chamber section into the second chamber section.

A latching means are provided to fix the movable door in a transverse position within the chamber to thereby divide the internal chamber into the front and rear sections. The latching means are provided with a disengaging assembly which can be operated from the front of the trash compactor.

Upon disengaging the latching means, the support door may then be pushed into the second chamber simultaneously as a filled trash container is pushed into the rear chamber section for storage or disposal. An empty trash container may then be placed into the front chamber section. The front panel of the filled trash container in the rear chamber section will support the rear panel of the trash container placed in the front chamber section when trash is compacted therein.

In an alternative embodiment, the rear chamber section is provided with a chute which directs filled trash container pushed into the rear chamber to a storage area disposed beneath the flooring supporting the trash compactor. In this embodiment, after the disposal of the trash container down the chute to the storage area the support door is then repositioned and fixed transversely in the chamber to provide support for a new trash container placed in the front chamber section. This embodiment is particularly attractive in wide bodied aircraft which has a significant amount of space for the storage of such trash containers beneath the floor of the passenger compartment.

The present invention provides for a substantially improved trash compactor system, particularly in those situations in which large volumes of trash are generated, such as in a long transcontinental and transoceanic flights of wide bodied jets. These and other advantages of the invention will become more apparent from the following detailed description thereof and the accompanying exemplary drawings.

BRIEF DESCRIPTION OF THE DRAWINGS

FIG. 4 is a perspective view of a support door which is disposed in the interior chamber of the trash compactor to support the rear panel of a trash container disposed within the front chamber during the compaction of trash therein and the mechanism for operating the door;

FIG. 5 is a rear view of the door shown in FIG. 4 with the adjacent walls and flooring being shown in phantom;

FIG. 6 is a partial side view of the operating mechanism for the latch system shown in FIG. 4;

FIG. 7 is a top view of the support door shown in FIG. 5 taken along the lines 7—7;

FIG. 8 is a plan view in section taken along the lines of 8—8 shown in FIG. 3 illustrating the disposition of a filled trash container in the rear chamber section and an empty trash container disposed within the first chamber section.

In the drawings, all corresponding parts are numbered the same.

DETAILED DESCRIPTION OF THE INVENTION

Figure 1:
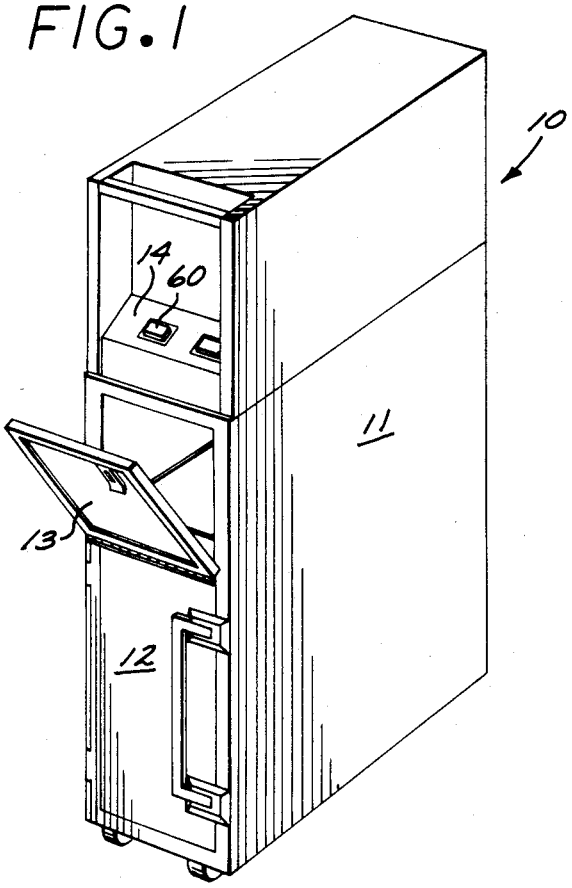
FIG. 1 is a perspective view of a trash compacting system embodying features of the invention.
Figure 2:
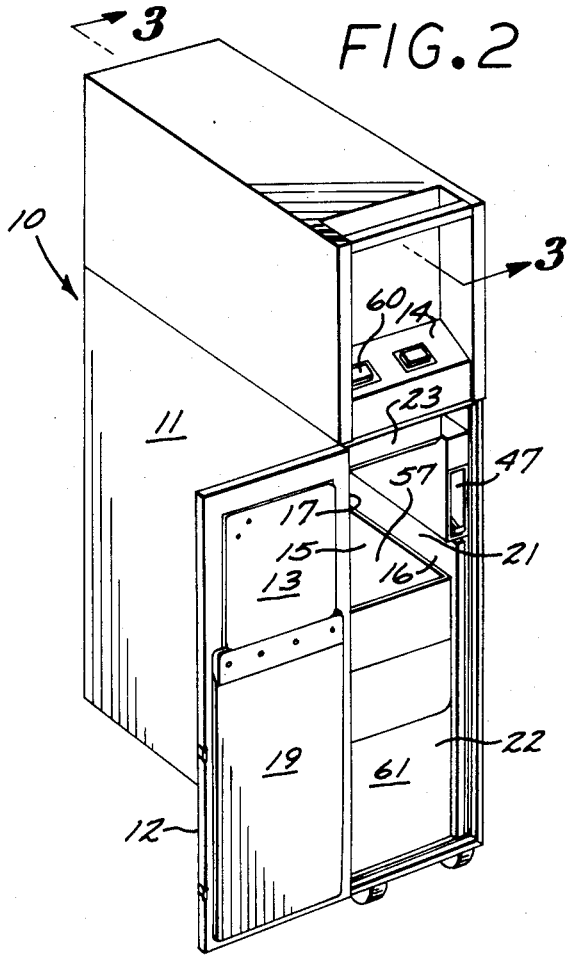
FIG. 2 is another perspective view of the trash compactor shown in FIG. 1 with the front door open to show the interior thereof.
Figure 3:
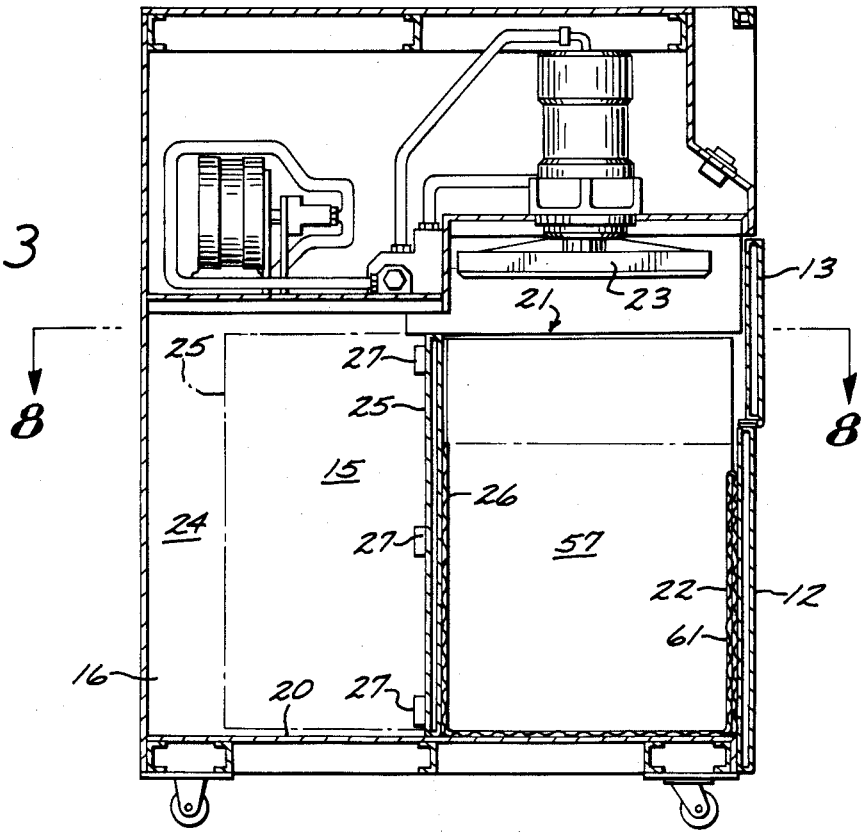
FIG. 3 is a sectional view of the trash compactor shown in FIG. 2 taken along the lines 3—3 but with the front door closed.

Reference is made to FIGS. 1-3 which illustrate an improved trash compacting system embodying features of the invention. The trash compactor 10 generally includes a cabinet 11, a front door 12, a trash chute 13 for dropping trash into the interior of the compactor 10, and a control panel 14 for operating the compactor 10.

With particular reference to FIGS. 2 and 3, the compactor 10 is provided with an elongated internal chamber 15 defined in part by opposing sidewall 16 and 17, the rear wall 18, the inside surface 19 of front door 12, and a floor 20. The internal chamber 15 comprises a front chamber section 21 wherein trash is compacted in a trash container 22 disposed therein by a compactor platen or ram 23, and a rear chamber section 24 wherein filled trash containers 22 are stored or disposed. The front and rear sections 21 and 24 are divided by a movable support door or wall 25 which is adapted to support the rear panel of a container 22 disposed in the front section 21 while trash is compacted therein by the compactor ram 23.

As shown in FIG. 3, the vertically oriented, movable support door 25 is preferably pivotally mounted onto sidewall 16 by means of hinges 27 so that it can be pivoted about the vertical aix of the hinges 28 into an out-of-the-way position in the rear chamber section 24 to facilitate moving a trash-filled container 22 from the front chamber section 21 to the rear chamber section 24.

As shown in FIGS. 4-7, latching means 30 are provided to fix the position of the movable support door 25 transversely across the chamber 15 so that the door 25 may support the rear panel 26 of a trash container 22 disposed within the first chamber section. The latching means 30 generally comprise latch pins or rods 31 which are slidably mounted onto the back side of door 25 by means of brackets 32 and are biased toward the sidewall 17, i.e., the closed position, by springs 33 and collar 34 which are fixed to the rod 31 to urge the end 35 of the rod 31 into the recess 36 provided in the sidewall 17. The opposite ends 37 of the rods 31 are pivotally mounted to lower cranks 40 by crank pins 41. The lower cranks 40 are securely mounted to hinge post 42 by means of locking pins 43 (shown in phantom in FIG. 7). An upper crank 44 is securely mounted to the upper end of hinge post 42 in the same manner as the lower cranks 40, but it is mounted at an angle from the lower crank 40. An operative arm 45 is pivotally connected to the upper crank 44 at one end thereof by crank pin 46 and extends to the front of the compactor 10 where the opposite end thereof is connected to an actuating assembly 47 by means of connecting element 48.

The actuating assembly 47, as shown in more detail in FIGS. 5 and 6, generally comprises a housing 50 and a generally L-shaped handle 51 pivotally connected at one end thereof to connecting element 48 secured to operating arm 45. A strut 52 is pivotally mounted at one end thereof to the center of the L-shaped handle 51 and at the other end thereof is pivotally mounted to a base element 53 in housing 50. By pulling upwardly on the operating end 54 of L-shaped handle 51, as shown in phantom in FIG. 6, the upper crank 44 is rotated clockwise by movement of the arm 45 toward the front of compactor 10, which in turn causes the clockwise rotation of the hinge post 42 and the lower cranks 40 which are secured thereto.

Upon the clockwise rotation of the lower crank 40, the latch pin or rods 31 are pulled toward the hinged margin 55 of the support door 25 so as to disengage the ends 35 of the rods 31 from the recesses 36 provided on the sidewall 17 and thereby release the support door 25 from its fixed transverse position so that it is freely rotatable about the axis of the hinge post 42. The wall 25 may then be easily pushed into an out-of-the-way position in the rear chamber section 24 by pushing a filled trash container 22 in front chamber section 21 into the second chamber.

However, as described in copending application Ser. No. 781,391, filed Sept. 20, 1985, before the filled container 22 may be pushed into the rear chamber section 24, the hydraulically movable sidewall panel 56 in the front chamber section 21 is actuated to release the frictional engagement between the sidewall panel 56 and the adjacent container side panel 57 which builds up during the compaction of trash within the container 22.

To operate the trash compacting system of the invention, the front door 12 of the compactor 10 is opened, the movable support door 25 is latched into position transversing the interior chamber 15, perpendicular to the sidewalls 16 and 17 with the ends 35 of rods 31 urged into the receiving recesses 36 to thereby fix the position of the support door 25. An empty trash container 22 is placed into the front chamber section 21 of the trash compactor 10 and the front door 12 is then closed. The sidewall 17 and sidewall panel 57, the inside of door 12, and the movable support door 25 support the four side panels of the trash container 22 disposed in the first chamber so that there is no damage to the container 22 during the compaction of trash therein.

The trash is deposited into the container 22 through opened chute 13, as shown in FIG. 1. When the container 22 is suitably filled with trash, the compactor 10 is actuated by pressing the start button or switch 60 provided on the control panel 14 to initiate the downward thrust of the compactor platen or ram 23 into the container 22.

Upon completion of its compacting stroke, the ram 23 is automatically retracted from the container 22 into its starting position in the upper portion of the front chamber section 21, as shown in FIG. 3, so that additional trash may again be deposited into the trash container 22 through the opened chute 13. After several compacting sequences, the container 22 will be essentially full of compacted trash and will need to be replaced.

To replace the used trash containers 22 in front chamber section 21, the front door 12 is opened and the operative end 54 of the L-shaped handle 51 is lifted upwardly to thereby disengage the latching mechanism 30 so as to allow for the free rotation of the movable support door 25 to an out-of-the-way position within the rear chamber section 24 and the filled trash container 22 to be pushed simultaneously into the rear chamber section 24. A new empty container 22 may then be placed into the front chamber section 21 and the front door 12 closed so that trash can again be deposited into the container 22 as previously described. The front upstanding panel 61 of the filed trash container 22 in the rear chamber section 24 supports the rear panel 26 of the empty trash container placed in the front chamber section 21 in the same manner as the door 25.

Figure 9:
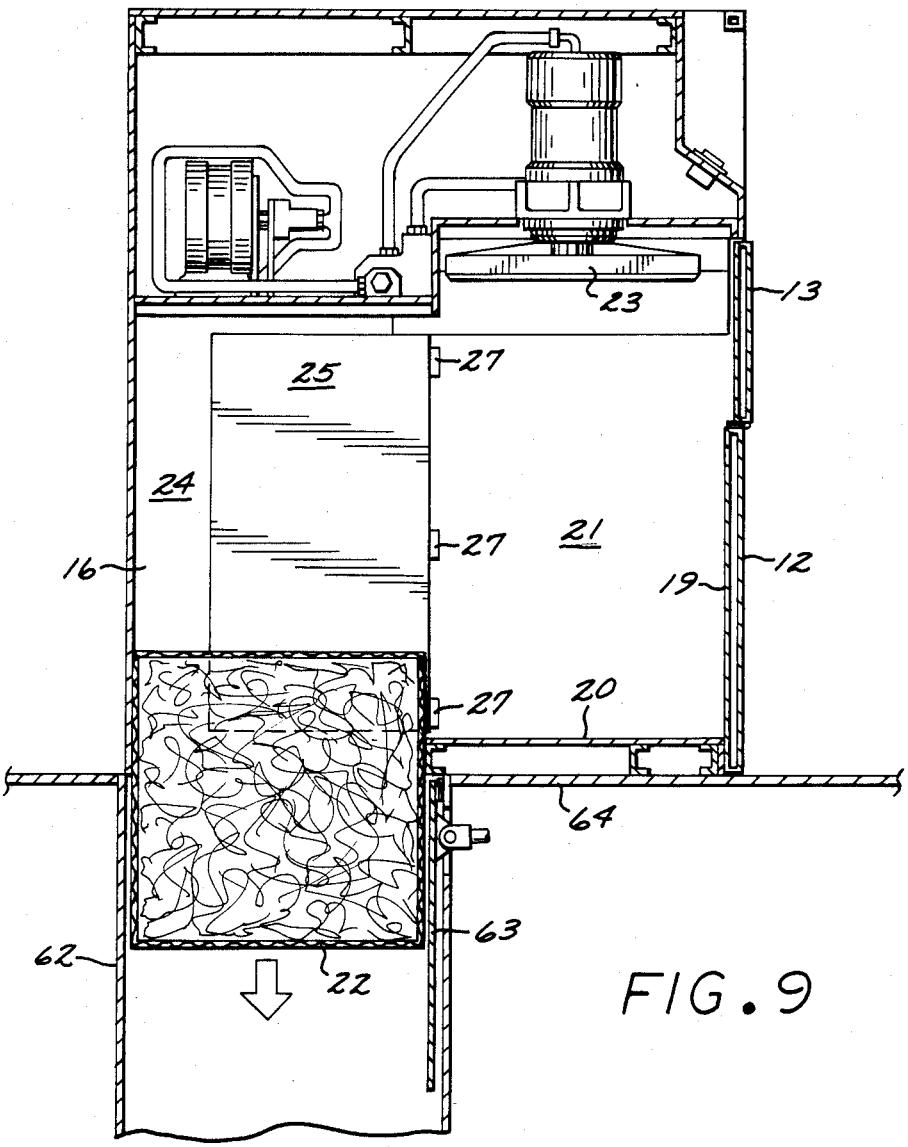
FIG. 9 is a side elevational view in section of an alternative embodiment wherein a chute is provided in the rear chamber for disposing of trash containers in a storage area beneath the compactor.

An alternative embodiment of the present invention is shown in FIG. 9 which involves providing a chute 62 in the rear chamber section 24 which leads to a storage are (not shown) beneath the flooring 63 if the passenger compartment of an aircraft. The chute 62 directs filled trash containers 22 which are pushed into rear section 24 to slide downwardly into a storage area beneath the flooring 63 which supports the trash compactor 10. A trap door 64 is provided in the floor of rear chamber 24 to support a container 22 therein until it is desired to drop the container down the chute 62. This embodiment is particularly desirable in large, wide-bodies aircraft which have significant space beneath the flooring of the passenger compartments. This embodiment may also reduce the number of trash compactors needed on each aircraft.

The details of the compacting system comprising the ram 23, the hydraulic system which drives the ram 23, and the controls therefor are described in detail in copending application Ser. No. 781,391, filed Sept. 20, 1985, assigned to the present assigness. Additionally, details of a preferred box construction are described in copending application Ser. No. 868,131, filed on May 28, 1986, also assigned to the present assignee. Both of these applications are hereby incorporated by reference in their entirety.

It is obvious that modifications can be made to the present invention. For example, the rear wall of the compactor may include a door for removing trash containers therefrom. Additionally, the movable door or wall which supports the rear panel of the container in the front chamber section may take different forms. For example, a segmented wall may be slidably supported in grooves along the sidewalls of the internal chamber and may be lifted upwardly to be moved to an out-of-the-way position. Other modifications can be made without departing from the scope thereof.

What is claimed is:

1. A trash compactor comprising:

a. a housing provided with an internal chamber having front and rear chamber sections which are adapted to receive trash containers;

b. means to deposit trash in a trash containers disposed within the front chamber section;

c. a reciprocating compacting platen which is extendable downwardly into the trash container disposed with the front chamber section to compact trash therein;

d. a moveable support wall transversely disposed in an interior chamber between the front and rear chamber sections;

e. means to fix the transverse position of the movable support wall between the front and rear chamber sections to facilitate the support of the rear panel of a trash container disposed within the front chamber section; and f. means to move the movable support wall from its fixed transverse position to an out-of-the-way position so that a trash container in the front chamber section may moved into the rear chamber section.

2. The trash compactor of claim 1 wherein latching means are provided to fix the transverse position of the movable support wall.

3. The trash compactor of claim 2 wherein means are provided to disengage the latching means to enable the movable support wall to be moved to the out-of-the-way position.

4. The trash compactor of claim 3 wherein the means for disengaging the latching means are provided in the front of the trash compactor.

5. The trash compactor of claim 2 wherein a side margin of the movable support wall is hingedly connected to a sidewall of the internal chamber between the front and rear chamber sections.

6. The trash compactor of claim 5 wherein the movable support wall is provided with means to latch the side margin thereof opposite the hinged side margin thereof to the adjacent sidewall of the internal chamber.

7. The trash compactor of claim 6 wherein the hinge connection between the movable support wall and the sidewall includes one or more hinges with a common hinge post, and wherein the latching means include an upper crank fixed to an upper end of the hinge post, one or more lower cranks fixed to lower portions of the hinge post, latch pins slidably mounted on the support wall and pivotally connected to the lower cranks, biasing mans to urge the latch pins toward recesses provided in a sidewall opposing the sidewall to which the support wall is hingedly connected, an operating arm pivotally connected at one end thereof to the upper crank and connected at the other end thereof to a an actuating assembly.

8. The trash compactor of claim 7 wherein the actuating assembly includes an L-shaped handle pivotally connected at one end thereof to the other end of the arm, and a strut which is pivotally connected at one end thereof to a center portion of the L-shaped handle and at the other end thereof to a connecting element in the housing.

9. The trash compactor of claim 1 wherein the rear chamber section is provided with a chute for direction trash containers moved into the rear chamber section to a storage area beneath the level of a surface supporting the compactor.

10. The trash compactor of claim 9 wherein the rear chamber section is provided with a trap door in the floor thereof to support a trash container thereon until the trap door is opened to allow the trash container to slide down the chute.

* * * * *

UNITED STATES PATENT AND TRADEMARK OFFICE

CERTIFICATE OF CORRECTION

PATENT NO. : 4,719,852

DATED : 1/19/88

INVENTOR(S) : Durbin et al.

It is certified that error appears in the above-identified patent and that said Letters Patent is hereby corrected as shown below:

Column 7, line 5, "direction" should read "directing".

Signed and Sealed this

Twelfth Day of July, 1988

*Attest:*

DONALD J. QUIGG

*Attesting Officer*

*Commissioner of Patents and Trademarks*

US004719852B1

REEXAMINATION CERTIFICATE (1665th)

United States Patent [19]

Durbin et al.

[11] B1 4,719,852

[45] Certificate Issued Mar. 24, 1992

[54] AIRCRAFT TRASH COMPACTOR

[75] Inventors: James L. Durbin, Valencia; Robert M. Clemens, Newhall, both of Calif.

[73] Assignee: Aero-Design Technology, Inc., Nev.

Reexamination Request:
No. 90/002,296, Mar. 15, 1991

Reexamination Certificate for:

| | |
|---|---|
| Patent No.: | 4,719,852 |
| Issued: | Jan. 19, 1988 |
| Appl. No.: | 889,685 |
| Filed: | Jul. 24, 1986 |

Certificate of Correction issued Jul. 12, 1988.

[51] Int. Cl.[5] ..... B30B 15/30
[52] U.S. Cl. ..... 100/229 A; 100/255
[58] Field of Search ..... 100/229 A, 255, 215, 100/229 R, 240; 53/527; 141/73, 80

[56] References Cited

U.S. PATENT DOCUMENTS 583,462 6/1897 Dederick .
3,514,969 6/1970 Harza .
3,557,683 1/1971 Boyd .
3,748,820 7/1973 Fox .
3,838,636 10/1974 Engebretsen .
3,861,117 1/1975 DeFilippi .
3,910,181 10/1975 Andrews et al. .
3,945,313 3/1976 Komberec et al. .
4,044,569 8/1977 Harza .
4,064,798 12/1977 Wolbrink et al. .
4,620,479 11/1986 Diamond et al. .

*Primary Examiner*—Andrew M. Falik

[57] ABSTRACT

An improved aircraft trash compactor having an elongated inner chamber which is separated into front and rear chamber sections by means of a movable door or wall disposed transversely across the width of the chamber. The movable door or wall supports the rear panel of the trash container in the front chamber section during the compaction of trash therein and may be moved to an out-of-the-way position to allow the filled trash container to be moved into the rear chamber section for storage or disposal. The filled trash container in the rear chamber section supports the rear panel of a trash container in the front chamber section during the compaction of trash therein.

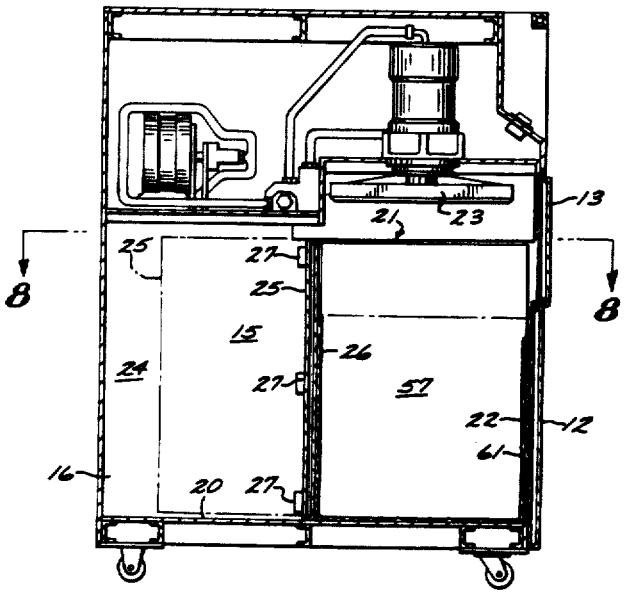

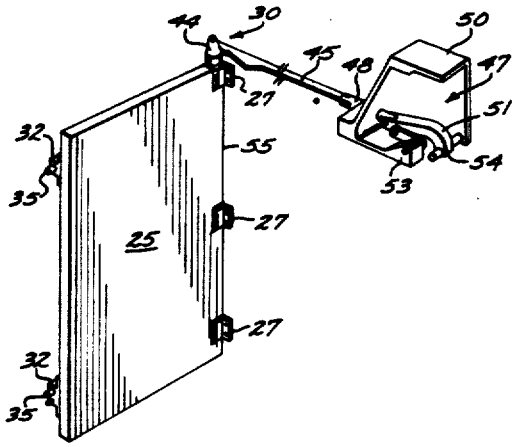

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 4, lines 8-30:

As shown in FIGS. 4-7, latching means 30 are provided to *securely* fix the position of the movable support door 25 transversely across the chamber 15 so that the door 25 may support the rear panel 26 of a trash container 22 disposed within the first chamber section. The latching means 30 generally comprise latch pins or rods 31 which are slidably mounted onto the back side of door 25 by means of brackets 32 and are biased toward the sidewall 17, i.e., the closed position, by springs 33 and collar 34 which are fixed to the rod 31 to urge the end 35 of the rod 31 into the recess 36 provided in the sidewall 17. The opposite ends 37 of the rods 31 are pivotally mounted to lower cranks 40 by crank pins 41. The lower cranks 40 are securely mounted to hinge post 42 by means of locking pins 43 (shown in phantom in FIG. 7). An upper crank 44 is securely mounted to the upper end of hinge post 42 in the same manner as the lower cranks 40, but it is mounted at an angle from the lower crank 40. An operative arm 45 is pivotally connected to the upper crank 44 at one end thereof by crank pin 46 and extends to the front of the compactor 10 where the opposite end thereof is connected to an actuating assembly 47 by means of connecting element 48.

AS A RESULT OF REEXAMINATION, IT HAS BEEN DETERMINED THAT:

The patentability of claims 2-7 and 8 is confirmed.

Claim 1 is cancelled.

Claim 9 is determined to be patentable as amended.

Claim 10, dependent on an amended claim, is determined to be patentable.

New claim 11 is added and determined to be patentable.

9. The trash compactor of claim 1 wherein the rear chamber section is provided with a chute for [direction] *directing* trash containers moved into the rear chamber section to a storage area beneath the level of a surface supporting the compactor.

*11. A trash compactor comprising:*

*a. a housing provided with an internal chamber having front and rear chamber sections which are adapted to receive trash containers;*

*b. means to deposit trash in a trash container disposed within the front chamber section;*

*c. reciprocating compacting platen which is extendable downwardly into the trash container disposed within the front chamber section to compact trash therein;*

*d. a movable support wall transversely disposed in an interior chamber between the front and rear chamber sections;*

*e. means to fix securely the transverse position of the movable support wall between the front and rear chamber sections to support the rear panel of a trash container disposed within the front chamber section during the compaction of the trash therein; and*

*f. means to move the movable support wall from its fixed transverse position to an out-of-the-way position so that a trash container in the front chamber section may be moved into the rear chamber section.*

* * * * *